US005338044A

United States Patent [19]

Mazursky et al.

[11] Patent Number: 5,338,044

[45] Date of Patent: Aug. 16, 1994

[54] WATER TOY

[75] Inventors: Richard B. Mazursky, Glenview; David M. Waskin, Chicago, both of Ill.; Steven N. Taylor, Torrance, Calif.

[73] Assignee: Vtech Industries, Inc., Wheeling, Ill.

[21] Appl. No.: 876,194

[22] Filed: Apr. 30, 1992

[51] Int. Cl.[5] ..... A63B 63/00

[52] U.S. Cl. ..... 273/402; 273/1.5 A; 446/199; 446/320

[58] Field of Search ..... 273/1.5 A, 1.5 R, 402, 273/389, 398, 348, 354; 446/176, 199, 475, 320

[56] References Cited

U.S. PATENT DOCUMENTS

| | | | |
|---|---|---|---|
| 374,960 | 12/1887 | Gumaer et al. . | |
| 2,030,605 | 2/1936 | Moore | 446/199 X |
| 2,634,545 | 4/1953 | Gertz | 46/41 |
| 2,757,960 | 8/1956 | Hatcher | 299/65 |
| 2,954,932 | 10/1960 | Albano | 239/188 |
| 3,079,727 | 3/1963 | Melin . | |
| 4,235,378 | 11/1980 | Melin | 239/229 |
| 4,286,779 | 9/1981 | Collins | 273/402 |

*Primary Examiner*—Mickey Yu

*Attorney, Agent, or Firm*—Dick and Harris

[57] ABSTRACT

A water toy for use in association with an external water supply and a water pipe, such as a garden hose. A shaft has a bottom end operatively attached to a base member and a top end opposite to the bottom end. A water flow directing element is operatively attached adjacent the top end of the shaft and has a first end attached to the water pipe and one or more second ends which are attached to a corresponding number of flexible members. Each of the flexible members have a second end region which allow for the discharge of water. The forces applied by the water from the external water supply to the internal wall of the flexible members imparts random movement to the flexible members. A target is operatively attached to the spacing member or a portion of the flexible members so as to prompt physical interaction between a user of the water toy and the toy itself.

21 Claims, 3 Drawing Sheets

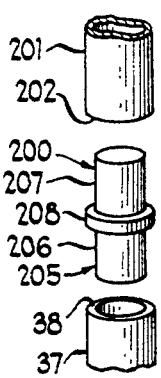
Fig 7
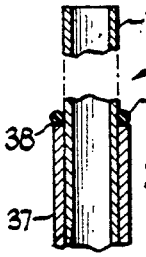
Fig 8
Fig 9
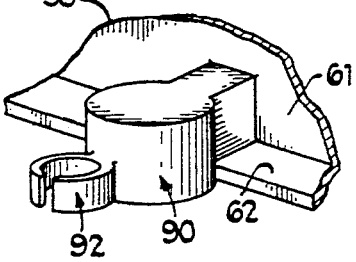
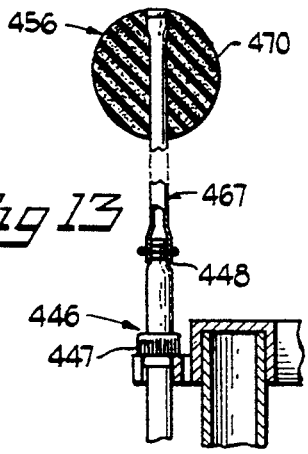
Fig 13
Fig 5
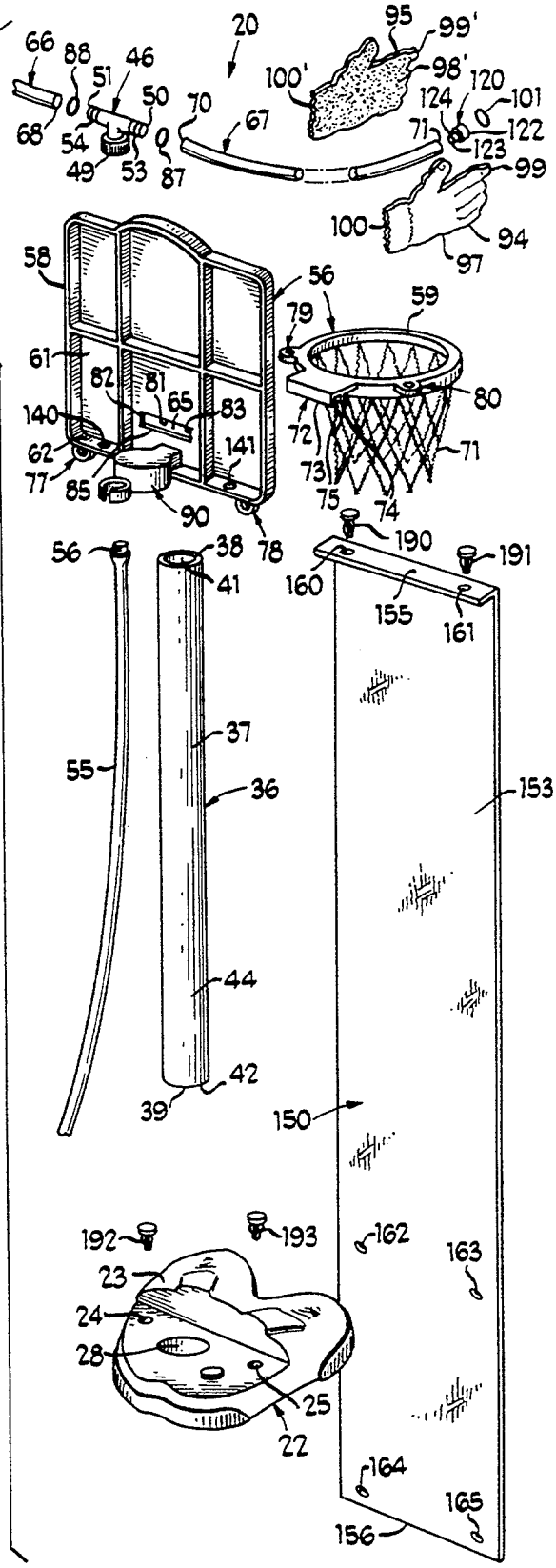

WATER TOY

BACKGROUND OF THE INVENTION

1. Field of the Invention

This invention relates generally to water toys, and more particularly, the water toys having flexible members which move in a random pattern as the result of water pressure exerted upon the inner walls of the flexible members, and which provides a target which prompts physical interaction between the user of the water toy and the toy itself.

2. Background Art

Water toys, of the type primarily intended for use with an external water supply, have been around for many years. Indeed, some of such water toys have even utilized flexible members which not only allow for the discharge of water from their respective free ends, but which also move in a random, or undulated pattern as the result of the forces being applied to the internal walls of the flexible members from the pressure of the water being supplied thereto. An example of such prior art is U.S. Pat. No. 4,235,378, issued to Melin, for a water play toy. Although such prior art utilizes flexible members which discharge water, the flexible members do not cooperate with a target for prompting direct and/or indirect physical interaction between an individual playing with the water toy and the toy itself.

While prior art devices have disclosed an object attached to the water discharge end of a flexible member, such objects, and, in turn, the overall devices themselves, are not intended for use as a toy, let alone for physical interaction with a user of the device. Indeed, such attached objects have been used to distribute water therefrom to, among other thins, water a lawn. An example of such a prior art device is U.S. Pat. No. 2,954,932, issued to Albano. The '932 reference utilizes an airplane-like object which is attached to the end of a flexible member. After an external water source is turned on and water is supplied through the flexible member, the flexible member and airplane-like object begin to circulate above the base of the device. As the airplane circulates, water is sprayed on the lawn through discharge holes located on the airplane-like object. Accordingly, any physical interaction with the airplane, such as throwing a projectile at it, or otherwise physically hitting it, would not only interfere with the circular "watering pattern" of the device, but it could damage the device as well.

SUMMARY OF THE INVENTION

The present invention comprises a water toy for use in association with an external water supply and a water pipe, such as a garden hose.

The water toy comprises means for providing a base for the water toy, wherein the base means has an exterior surface. Water flow directing means which direct the flow of water from the external water supply, and, in turn, from the water pipe, to an outlet location, are separated from the base means by spacing means. The water flow directing means have a first end operatively attachable to the water pipe, and one or more second ends distally spaced from the first end. One or more flexible members are operatively attached to the water flow directing means. The flexible members include an inner wall, a transverse cross-sectional dimension, a first end region operatively attached to the one or more second ends of the water flow directing means and a second end region opposite and distal to the first end region. In addition, the second end regions allow for the discharge of water originally supplied from the external water supply. The external water supply actually supplies water to the water toy, and, in turn, the one or more flexible members, at a sufficient pressure so as to impart random movement of the one or more flexible members as the result of forces applied to their respective inner walls. Target means are operatively attached to a portion of at least one of the spacing means and/or the one or more flexible members so as to prompt physical interaction between a user of the water toy and the water toy itself.

In the preferred embodiment of the invention, the water toy includes means for altering the pressure of the water from within the one or more flexible members. The water pressure altering means comprises a nozzle operatively positioned in abutment with at least a portion of the inner wall of the one or more flexible members. In addition, the nozzle includes an opening having a smaller transverse cross-sectional dimension than the transverse cross-sectional dimension of the one or more flexible members.

Also in the preferred embodiment of the invention, the water toy further includes means for obstructing a projectile directed at the target means. The obstructing means are operatively attached to a portion of at least one of the one or more flexible members.

The obstructing means may comprise at least one hand-like member operatively attached adjacent the second end region of the one or more flexible members. These hand-like members include a tip portion, a back portion, an internal section, a first opening positioned adjacent the back portion and a second opening positioned adjacent the tip portion. At least a region of the one or more flexible members are positioned within the internal section through insertion of the second end region of the one or more flexible members through the first opening. The second end region is positioned adjacent the second opening in the hand-like member so as to enable the discharge of water through the second end regions and through and past the second opening. In addition, the hand-like members may be attached to the one or more flexible members by releasable securing means. Similar releasable securing means may also be used to secure the one or more flexible members to the water flow directing means.

In the preferred embodiment of the invention, the water toy further includes means for guiding at least a portion of the one or more flexible members adjacent the target means. The guiding means are operatively attached to a portion of at least one of the target means and/or the spacing means. Such guiding means may comprise hooks or loops made of metal or plastic.

In one embodiment of the invention, the target means comprises a basketball-like backboard operatively attached to the spacing means, and a basketball-like rim operatively attached to the basketball-like backboard.

In another preferred embodiment of the invention, the water toy further includes means for providing releasable engagement of a portion of the water flow directing means adjacent the spacing means. The releasable engagement means are operatively attached to at least one of the target means and/or the spacing means.

In another preferred embodiment of the invention, the water toy further includes means for returning a projectile towards the direction of its origin after a projectile has successfully hit the target means. It is contemplated that the return means comprise the base means having an angled configuration which would automatically direct the projectile, if it comes in contact therewith, back toward the direction of where the projectile originated.

In still another embodiment of the invention, the water toy further includes means for altering the center of gravity of the water toy so as to increase stability of the water toy during use thereof. The center of gravity altering means are operatively associated with the base means.

The base means includes a cavity, an orifice for providing access to the cavity and a plug removably attached within a portion of the orifice. The center of gravity altering means may include a selectively varied mass of weight material which is operatively and removably placed within the cavity through the orifice after removal of the plug. The plug is then reinserted within the portion of the orifice it was removed from after the material has been placed within the cavity.

In one preferred embodiment of the invention, the water toy further includes means for displaying graphics. The graphics display means include an elongated foldable panel having a front surface, a back surface, a top end and a bottom end, wherein at least one of the front and back surfaces are operatively positioned adjacent at least a portion of the spacing means. Furthermore, the front surface may display a figure corresponding to the specific type of target means to be used. For example, if the target means is a basketball backboard and rim, the front surface of the graphics display means may depict a basketball player.

The elongated foldable panel includes a plurality of attachment regions to enable alternative regions of attachment of the graphics display means to at least one of the base means and/or for the target means. The base means and the target means each have corresponding attachment acceptance holes, and a corresponding number of removable attachment clip members, so as to enable operative cooperation between the attachment regions of the graphics display means and the attachment acceptance holes. The foldable elongated panel is foldable adjacent various ones of the plurality of attachment regions so as to alter the length of exposure of the graphics display means upon attachment to at least one of the base means and the target means.

In one embodiment of the invention, the first end of the water flow directing means is operatively attachable juxtaposed the top end of the hollow shaft member and the water pipe is positioned external to the hollow shaft member of the spacing means. In another embodiment, a portion of the water pipe is operatively insertable through the hollow shaft member.

In a preferred embodiment of the invention, the spacing means includes means for adjusting the length of the hollow shaft member so as to alter the distance between the target means and the base means. The length adjusting means comprises an inner post member slidably positioned within at least a portion of the hollow shaft member. The inner post member has an outer diameter smaller than the inner diameter of the hollow shaft member so as to facilitate slidable movement therebetween. In addition, the inner post member and the hollow shaft member are releasably maintained in operative alignment with each other by positioning means.

The positioning means may include means for providing frictional engagement between the outer diameter of the inner post member and the inner diameter of the hollow shaft member so as to releasably maintain the inner post member and the hollow shaft member in operative alignment with each other.

Alternatively, the length adjustment means may include an extension post and an adapter element. The adapter element has a shaft insertion end, a post insertion end and a spacer element therebetween. The shaft insertion end is operatively positioned within the hollow shaft member adjacent the top end of same, and, a portion of the extension post is operatively positionable over and about the post insertion end of the adapter element so as to result in a releasable and substantially concentric alignment between the hollow shaft member and the extension post.

BRIEF DESCRIPTION OF THE DRAWINGS

For a better understanding of the present invention, reference may be had to the accompanying drawings in which:

FIG. 5 is a partial exploded perspective view of the water toy;

FIG. 7 is a partial exploded view of the extension post, adapter element and hollow shaft member;

FIG. 8 is a fragmentary cross-sectional view of the inner post member, the hollow shaft member and the frictional engagement means;

FIG. 9 is an enlarged scale fragmentary view of the attachment cap and integrally formed releasable engagement means;

FIG. 13 is an elevated side partial cross-sectional view of one embodiment of the present water toy.

DETAILED DESCRIPTION OF THE DRAWINGS

Figure 1:
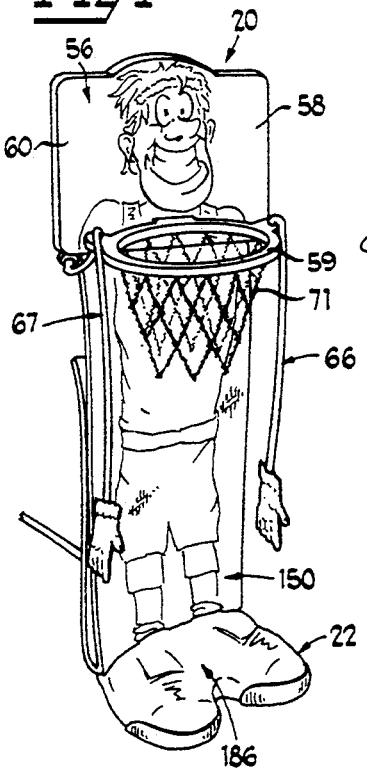
FIG. 1 is a perspective view of one of the embodiments of the present invention prior to water being supplied thereto from an external water source.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 2:
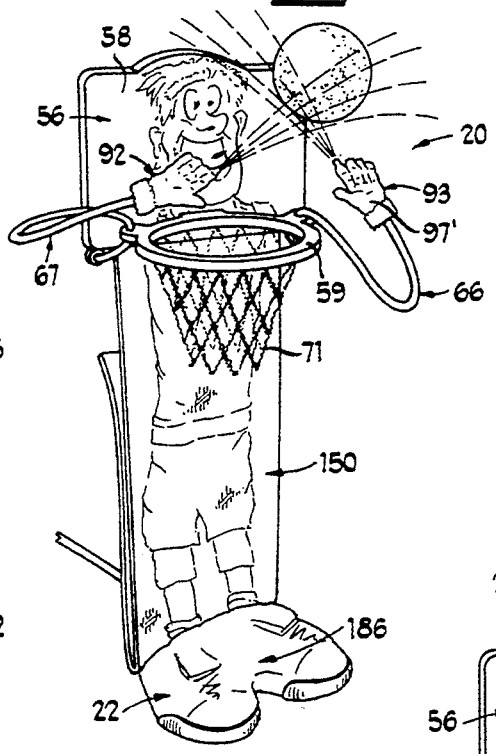
FIG. 2 is a perspective view of one of the present invention after water has been supplied thereto from an external water source, showing, in particular, the adjacent positioning of the obstructing means in relation to the target means, as well as showing a projectile thrown toward the target means.
Figure 3:
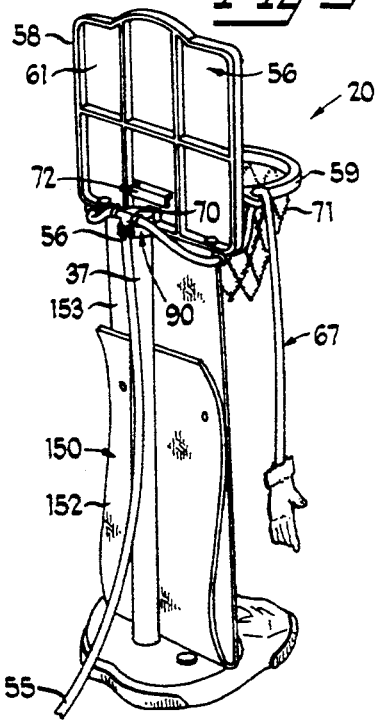
FIG. 3 is a rear perspective view of the present water toy prior to the water being supplied thereto from an external water supply.

Water toy 20 is shown in FIGS. 1 through 5 as including base means 22, spacing means 36 (FIG. 5), water flow directing means 46 (FIG. 5), target means 56, flexible members 66 and 67, guiding means 77 through 80 (FIG. 5), projectile obstructing means 92 (FIGS. 2 and 4) and graphics display means 150. Base means 22 is shown in FIG. 5 as including exterior surface 23, lower attachment acceptance holes 24 and 25 and spacing means receiving region 28. Spacing means 36, which is operatively attached to base means 22 at spacing means receiving region 28, as shown in FIG. 3, comprises a hollow shaft 37 having a top end 38, a bottom end 39, a first aperture 41, a second aperture 42, an outer surface 44 and an inner diameter (not shown).

Water flow directing means 46, which is operatively positioned adjacent top end 38 of hollow shaft 37 (FIG. 3), is shown in FIG. 5 as including first end 49 and second ends 50 and 51 which are distally spaced from the first end. Each of second ends 50 and 51 include barbed portions 53 and 54, respectively. These barbed portions facilitate frictional engagement with a portion of the respective flexible members 66 and 67 after the flexible members are stretched over the barbed portions. Although not shown, first end 49 of the water flow directing means is threaded so as to enable the threaded receipt of the connecting end 56 of water pipe (garden hose) 55 (FIGS. 3 and 5). Although water flow directing means 46 is shown as having a T-shaped configuration, other types of configurations which allow attachment of one, two, or more than two flexible members are also contemplated.

Target means 56 (FIGS. 3 and 5) includes a basketball-like backboard 58 and a basketball-like rim 59 attached to the backboard. Backboard 58 includes a front surface 60 (FIG. 1), a back surface 61, a bottom peripheral edge 62, a slot 65 (FIG. 5) which passes through the front and back surfaces, attachment cap 90 and upper attachment acceptance holes 140 and 141. Slot 65 includes a bottom edge 85, a top edge 81 and two side edges 82 and 83. Attachment cap 90, as shown in detail in FIG. 9, is integrally attached adjacent back surface 61 of the backboard 58 and is used for slidable attachment over top end 38 of hollow shaft 37. Attachment cap 90 includes releasable engagement means 92, which is integrally attached to the cap, and which is used to releasably secure water flow directing means 46 thereto, as shown in FIG. 3. Although releasable engagement means 92 may comprise a C-clamp, other types of releasable engagement means which are not integrally attached to cap 90, such as hose clamps and/or wire or nylon ties, are also contemplated.

Basketball-like rim 59 includes net 71 and attachment lip 72 (FIG. 5). Attachment lip 72 has a configuration similar to, yet smaller than slot 65 in backboard 58 so as to facilitate operative cooperation therebetween. Attachment lip 72 includes first wall 73, second wall 74 and channel 75 which is positioned between the first and second walls. Accordingly, attachment of rim 59 to backboard 58 is accomplished by inserting lip 72 through slot 65 until first wall 73 is adjacent back surface 61 and second wall 74 is adjacent front surface 60. Once properly aligned, rim 59, and more particularly attachment lip 72, is pushed downward toward bottom peripheral edge 62 of backboard 58 until channel 75 abuts with bottom edge 85 of slot 65. Backboard 58 and rim 59 additionally include guide means 77 and 78, and, 79 and 80, respectively. These guide means position at least a portion of the flexible members 66 and 67 adjacent a portion of the front surface 60 of the backboard 58.

Flexible members 66 and 67 are shown in FIGS. 3 and 5 as comprising an inner wall 68 (FIG. 5) an inner diameter (not shown), a first end region 70 and a second end region 71 (FIG. 5). First end region 70 is operatively attached to second end, such as second end 50, of water flow directing means 46, and second end region 71 is operatively positioned adjacent tip portion 99, 99' of hand-like members 92, 92' as shown in detail in FIG. 6. Furthermore, the water which is supplied from an external water supply is eventually discharged through the second end regions of the flexible members. Although not shown, the inner diameter of the flexible members may be smaller than the inner diameter of the respective ends of the water flow directing means 46. Accordingly, such a smaller diameter causes a change in water pressure between the water flow directing means and the flexible members—thus causing the flexible members to move about in a random manner. Although the second end regions are operatively attached about barbed portions 53 and 54 of water flow directing means 46, additional securement therebetween is accomplished by utilization of securement means 87 and 88 (FIG. 5). Securement means 87 and 88 may comprise elastomeric O-rings, however, other types of securement means, such as metal clamps and other types of conventional elastomeric products, such as rubber bands, are also contemplated for use.

Projectile obstructing means 93 is shown in FIG. 2 and FIG. 5 as comprising hand-like members having a first half 94 and a second half 95. Each of these halves have an exterior surface 97, 97', an interior surface 98, 98' (FIGS. 5 and 6) which when operatively attached to each other define an interior region (not shown), a tip portion 99, 99' and a back portion 100, 100' (FIG. 5). As shown in detail in FIG. 9,a portion of the flexible members, such as flexible member 67, is sandwiched between first and second halves 94 and 95, respectively, and accordingly, operatively positioned within the interior region of the hand-like members. When flexible member 67 is properly positioned within the interior region, second end region 71 of flexible member 67 will be positioned adjacent tip portion 99, 99' of the hand-like member—so as to allow water to be discharged therefrom. Although a portion of the flexible members are "sandwiched" between the two halves of the hand-like members, additional securement therebetween is accomplished by utilization of tip securement means 101. Tip securement means 101, which may be constructed in substantially the same way as securement means 87 and 88 (as previously explained) is attached over and about tip portion 99, 99' of the hand-like member, and, in turn, over and about second end region 71 of the flexible member. Although the projectile obstructing means are shown as hand-like members, other configurations and/or objects can also be used.

Figure 6:
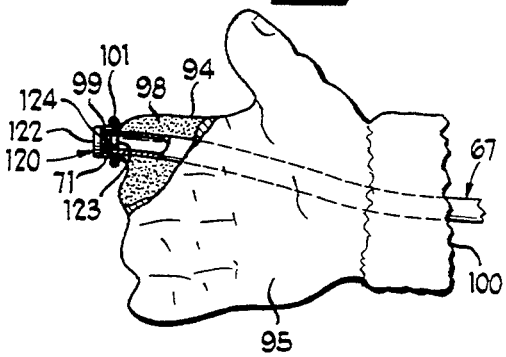
FIG. 6 is an enlarged scale fragmentary view of one of the hand-like members, showing, in particular, the positioning of the flexible member between the two halves of the hand-like member.

Water pressure altering means 120 is shown in FIGS. 5 and 6 as comprising a nozzle having a discharge end 122, a distal end 123 and a barbed shaft 124. The nozzle is operatively positioned within flexible member 67 so that discharge end 122 is positioned adjacent and external to second end region 71 of the flexible member. Barbed shaft 124 has an outer diameter slightly larger than the inner diameter of the flexible member. Accordingly, securement between the flexible member and the nozzle is achieved by stretching the flexible member over and around the barbed portion. Further securement is achieved through use of tip securement means 101 as previously described. Inasmuch as nozzle 120 occupies a portion of the inner diameter of the flexible members, the flow of water through the flexible member will be restricted and, in turn, will cause a choking effect which will contribute to the random movement of the flexible members.

Figure 4:
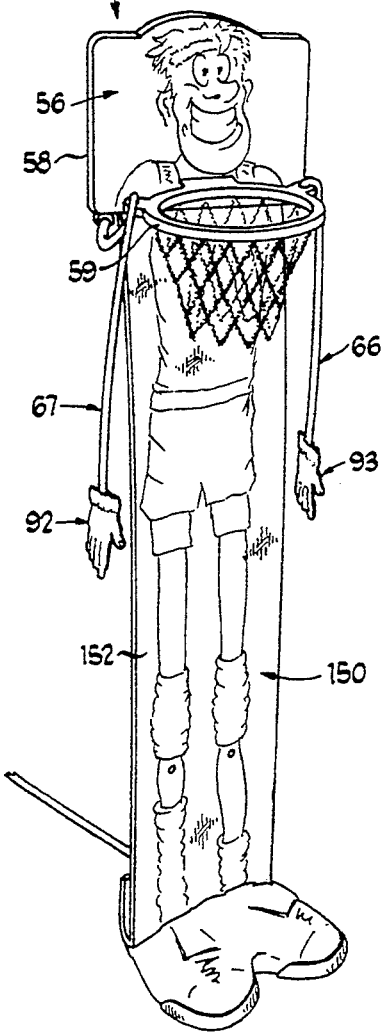
FIG. 4 is a front perspective view of the present invention prior to water being supplied thereto from an external water supply.

Graphics display means 150 which comprises an extendible foldable panel, is shown, in FIG. 3 through 5 as including a front surface 152 (FIGS. 3 and 4), a back surface 153, a top end 155, a bottom end 156, and, attachment regions 160 through 165, as shown in FIG. 5. Attachment regions 160 and 161 cooperate with upper attachment acceptance holes 140 and 141 in backboard 58 (FIG. 3) and attachment regions 162 and 163 (FIG. 3), or, alternatively, attachment regions 164 and 165 cooperate with lower attachment acceptance holes 24 and 25 (FIG. 4) in base means 22. Actual securement between the attachment regions and the respective upper and lower attachment acceptance holes is achieved by the use of attachment clips 190 through 193 (FIG. 5). Attachment regions 162 and 163 will be used when graphics display means 150 is in the folded position, as shown in FIG. 3, and attachment regions 164 and 165 will be used when the graphics display means is in an unfolded position, as shown in FIG. 4.

In operation, a user, after attaching the garden hose 55 to water flow directing means 46, turns on the external water supply. The water will pass through the water flow directing means and into each respective flexible member 66 and 67. As previously explained, the flexible members will move about in a random pattern due to the smaller inner diameter between the flexible members (and/or the use of water pressure altering means 120) and the water flow directing means. Furthermore, inasmuch as a portion of the flexible members are inserted through and restricted by guide means 77 through 80 (on backboard 58 and rim 59), the random movement of the flexible members will occur in the vicinity of the backboard 58 and rim 59. Additionally, as the flexible members move about, in cooperation with the water being discharged from second end region 71 of the flexible members, the hand-like members serve to obstruct a projectile, such as a ball 185 (FIG. 2) from successfully hitting the target (in this case, through the rim). Furthermore, if the projectile has successfully passed through the obstructing means, and has passed through the rim, the projectile (ball) will then eventually drop down into contact with base means 22. Base means 22 includes angled projectile return means 186 as shown in FIGS. 1 and 2. The projectile return means comprises the base means being configured to have its front portion angled outwardly (with respect to the front surface of the graphics display means), and then downward towards the ground, so as to direct the ball back towards the user.

Two alternative embodiments of length adjusting means 200 and 220 are shown in FIG. 7 and FIG. 8, respectfully. In particular, length adjusting means 200 includes extension post 201 and adapter element 205 for use in cooperation with top end 38 of hollow shaft 37. Extension post 201 comprises a hollow tube of similar construction to that of hollow shaft 37 and includes a bottom end 202, a top end (not shown) and an aperture (not shown) positioned at the bottom end 202. Adapter element 205 includes a shaft insertion end 206, a post insertion end 207 and a spacer element 208 positioned therebetween. Shaft insertion end and post insertion end have an outer diameter slightly smaller than the inner diameter of extension post 201 and hollow shaft 37, respectively, while spacer element 208 has an outer diameter substantially equal to that of the outer diameters of the extension post and the hollow shaft.

Should a user be desirous of increasing the distance between the base means 22 (FIG. 3) and the target means 56, then shaft insertion end 206 of adapter element 205 is inserted within first aperture 41 of hollow shaft 37 (FIG. 5) until spacer element 208 abuts with top end 38. Next, the user simply slides the bottom end 202 of extension post 201 over and around post insertion end 207 of adapter element 205 and into abutment with spacer element 208. Once such positioning has occurred, attachment cap 90, as shown in FIG. 9, is slidably inserted over the top end of extension post 201. When extension post 201 is utilized, graphics display means 150 may be unfolded so that bottom attachment regions 164 and 165 can be operatively secured to lower attachment acceptance holes 24 and 25, as shown in FIG. 4.

Length adjusting means 220 is shown in FIG. 8 as including extension post 221 and friction engagement means 225 slidably positioned around the outer diameter of extension post 221. Extension post 220 has an outer diameter smaller than the inner diameter of hollow shaft 37 so as to enable slidable movement therebetween. Friction engagement means 225, which may comprise a conventional O-ring, is stretched about the outer diameter of the extension post. Accordingly, to maintain a desired length beyond the top end 38 of hollow shaft 37, a user simply slidably raises the extension post and then slides the friction engagement means into abutment with the top end of the hollow shaft. The friction engagement means then serves to preclude the extension post from inadvertently sliding into hollow shaft 37.

Figure 10:
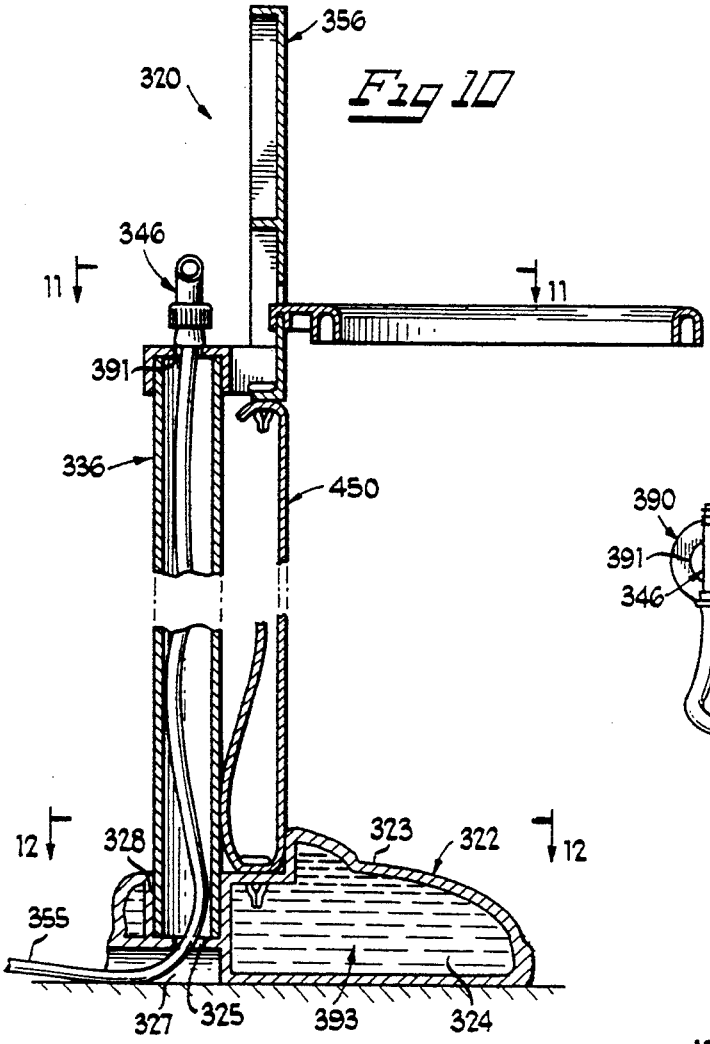
FIG. 10 is an elevated side cross-sectional view of one embodiment of the present invention, showing the positioning of the water pipe through a portion of the base means and through the hollow shaft, as well as the center of gravity altering means.
Figure 11:
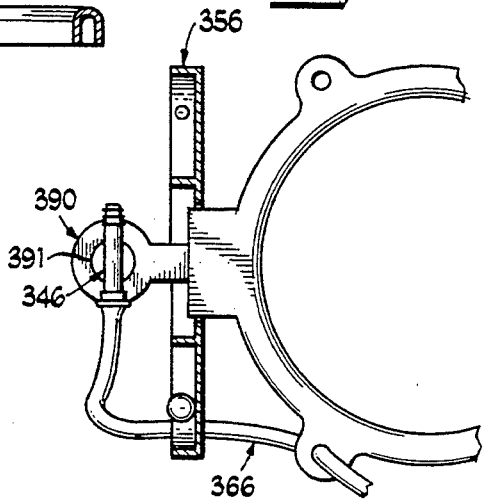
FIG. 11 is a fragmentary cross-sectional view taken generally along lines 11—11 of FIG. 10 with part of the rim broken away.
Figure 12:
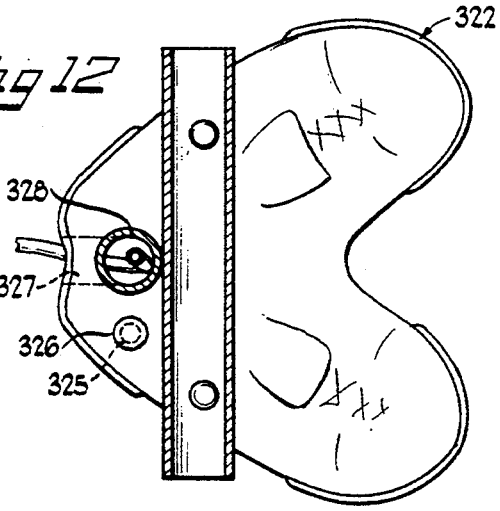
FIG. 12 is a fragmentary cross-sectional view of the present invention taken generally along lines 12—12 of FIG. 10.

Water toy 320 is shown in FIG. 10 as including base means 322, spacing means 336, water flow directing means 346, target means 356, flexible members, such as flexible member 366 (FIG. 11), and graphics display means 450. Inasmuch as water toy 320 is configured in substantially the same way as water toy 20, as previously described in FIGS. 1 through 5, further reference will be made only to the elements which differ from those previously described in those Figures. Accordingly, base means 322 includes exterior surface 323, cavity 324, orifice 325 (FIG. 12 ), plug member 326 (FIG. 12), water pipe insertion section 327, aperture 325 and spacing means receiving region 328 (FIGS. 10 and 12). Target means 356 includes an attachment cap 390, as shown in FIG. 11, for providing attachment between the target means and the top end of the spacing means. Attachment cap 390 includes opening 391 which has a diameter slightly larger than the outer diameter of a conventional garden hose 355.

Garden hose 355 is connected to water flow directing means by inserting the garden hose through water pipe insertion section 327 and through aperture 325. The hose is then pushed through the hollow section of spacing means 336 and forced upward through opening 391 of attachment cap 390. Water flow directing means 346 is then threadedly attached to the conventional garden hose. It is contemplated that the water flow connecting means be positioned above, or partially through opening 391 of attachment cap 390.

To reduce the likelihood that water toy 320 will tip over during use, base means 322 further includes center of gravity altering means 393, as shown in FIG. 10. The center of gravity altering means, which may comprise water, is inserted within cavity 324 after removing plug 325 from orifice 326 (FIG. 12) and then pouring the center of gravity altering means therein. Although the center of gravity altering means may comprise water, any other type of mass which is fluid, such as sand or stones, and which can be poured through the orifice, are also contemplated for use.

An alternative target means 456 and alternative water flow directing means 446 are shown in FIG. 13 wherein the water flow directing means has a first end 447 and a second end 448. The first end is threadedly attached to a garden hose, and the second end is attached to a flexible member 467. The flexible member has a first end region attached to the second end of the water flow directing means, and a second end region 468 which allows for the discharge of water. The target, which comprises ball 470, is operatively attached to the second end region of the flexible member. Accordingly, as water is injected into the flexible member, the flexible member, along with the ball, will begin to move in a random manner. As the ball is moving, a user is encouraged to hit the ball with his or her hand (so as to play a game similar to tether ball), or, through the use of a separate racquet. Although the single flexible member configuration shown in this embodiment is attached to ball 470, other types of objects which prompt physical interaction between a user of the water toy and at least a portion of the flexible member or members, through cooperation with or without a projectile, are also contemplated.

The foregoing description and drawings merely explain and illustrate the invention, and the invention is not limited thereto except in so far as the appended claims are so limited, as those skilled in the art who have the disclosure before them will be able to make modifications and variations therein without departing from the scope of the invention.

What is claimed is:

1. A water toy for use in association with an external water supply and a water pipe, such as a garden hose, said water toy comprising:

means for providing a base for said water toy, said base means having an exterior surface;

means for directing water flow from the external water supply, and, in turn, from the water pipe, to an outlet location, said water flow directing means having a first end operatively attachable to the water pipe, and one or more second ends distally spaced from said first end;

means for spacing said water flow directing means from said exterior surface of said base means;

one or more flexible members each having an inner wall, a transverse cross-sectional dimension, a first end region operatively attached to said one or more second ends of said water flow directing means and a second end region opposite and distal to said first end region, wherein said second end region allows discharge of water supplied from the external water supply, the external water supply supplying water to said water toy, and, in turn, said one or more flexible members, at a sufficient pressure so as to impart random movement of said one or more flexible members as the result of forces applied to said inner wall of said one or more flexible members from the water; and means for providing a target, said target means being operatively attached to a portion of at least one of said spacing means and said one or more flexible members so as to prompt physical interaction between a user of the water toy and the water toy itself;

means for obstructing a projectile directed at said target means, said obstructing means being operatively attached to said second end region of at least one of said one or more flexible members, said obstructing means having a dimension substantially larger than the transverse cross-sectional dimension of a corresponding one of said one or more flexible members.

2. The invention according to claim 1 in which the water toy further includes means for altering the pressure of the water from within said one or more flexible members.

3. The invention according to claim 2 wherein said water pressure altering means comprises a nozzle operatively positioned in abutment with at least a portion of said inner wall of said one or more flexible members, said nozzle including an opening having a smaller transverse cross-sectional dimension than the transverse cross-sectional dimension of said one or more flexible members.

4. The invention according to claim 1 in which said obstructing means comprise at least one hand-shaped member.

5. The invention according to claim 4 in which said hand-like members comprise:

a tip portion, a back portion, an internal section, a first opening positioned adjacent said back portion and a second opening positioned adjacent said tip portion, at least a portion of said one or more flexible members being positioned within said internal section through insertion of said second end region of said one or more flexible members through said first opening, said second end regions being positioned adjacent said second opening in said hand-shaped members so as to enable the discharge of water through said second end regions and through and past said second openings.

6. The invention according to claim 4 in which said water toy further includes means for releasably securing said hand-shaped members to said one or more flexible members.

7. The invention according to claim 1 in which said water toy further includes means for releasably securing said one or more flexible members to said water flow directing means.

8. The invention according to claim 1 in which the water toy further includes:

means for guiding at least a portion of said one or more flexible members adjacent said target means, said guiding means being operatively attached to a portion of at least one of said target means and said spacing means.

9. The invention according to claim 8 in which said target means comprises:

a backboard operatively attached to said spacing means, and a rim operatively attached to said basketball-like backboard.

10. The invention according to claim 1 in which:

said water flow directing means is operatively attached adjacent said top end of said spacing means;

said spacing means having a bottom end operatively attached to said base means and a top end opposite said bottom end;

said water toy further including means for providing releasable engagement of a portion of said water flow directing means adjacent said spacing means, said releasable engagement means being operatively attached to at least one of said target means and said spacing means.

11. The invention according to claim 1 in which said water toy further includes means for returning said projectile towards the direction of its origin after a projectile successfully hits said target means.

12. The invention according to claim 1 in which the water toy further includes:

means for altering the center of gravity of the water toy so as to increase stability of the water toy during use thereof, said center of gravity altering means being operatively associated with said base means.

13. The invention according to claim 12 in which said base means further includes a cavity, an orifice for providing access to said cavity and a plug removably attached within a portion of said orifice; and said center of gravity altering means including a selectively varied mass of weight material being operatively and removably placed within said cavity through said orifice after removal of said plug, said plug being reinserted within said portion of said orifice after said material has been placed within said cavity.

14. The invention according to claim 1 in which the water toy further includes:

means for displaying graphics, said graphics display means includes an elongated foldable panel having a front surface, a back surface, a top end and a bottom end, wherein at least one of said front and back surfaces are operatively positioned adjacent at least a portion of said spacing means.

15. The invention according to claim 14 in which said elongated foldable panel includes a plurality of attachment regions to enable alternative regions of attachment of said graphics display means to at least one of said base means and said target means, at least one of said base means and said target means having corresponding attachment acceptance holes and a corresponding number of removable attachment clip members so as to enable operative cooperation between said attachment regions of said graphics display means and said attachment acceptance holes, said foldable elongated panel being foldable adjacent various ones of said plurality of attachment regions so as to alter the length of exposure of said graphics display means upon attachment to at least one of said base means and said target means.

16. The invention according to claim 1 in which said spacing means comprises:

a hollow shaft member having a bottom end, a top end opposite said bottom end, a first aperture positioned adjacent said top end and a second aperture positioned adjacent said bottom end, said first end being operatively attached to said base means and said top end being positioned above and external to said exterior surface of said base means, said first end of said water flow directing means being operatively attachable juxtaposed said top end of said hollow shaft member.

17. The invention according to claim 16 in which a portion of the water pipe is operatively insertable through said first aperture of said hollow shaft member, said water pipe extending through said hollow shaft member until attachment with said first end of said water flow directing means.

18. The invention according to claim 1 in which said spacing means includes:

a hollow shaft member having a bottom end, a top end opposite said bottom end, a first aperture positioned adjacent said top end and a second aperture positioned adjacent said bottom end, said bottom end being operatively attached to said base means and said top end being positioned above and external to said exterior surface of said base means, said first end of said water flow directing means being operatively attachable juxtaposed said top end of said hollow shaft member; and means for adjusting the length of said hollow shaft member so as to alter the distance between said target means and said base means.

19. The invention according to claim 18 in which:

said hollow shaft member has an inner diameter, said length adjusting means comprises an inner post member slidably positioned within at least a portion of said hollow shaft member, said inner post member having an outer diameter smaller than the inner diameter of said hollow shaft member so as to facilitate slidable movement therebetween; and means for positioning said inner post member and said hollow shaft member in releasable and maintained operative alignment between same.

20. The invention according to claim 19 in which said positioning means includes means for providing frictional engagement between said outer diameter of said inner post member and said inner diameter of said hollow shaft member so as to releasably maintain said inner post member and said hollow shaft member in operative alignment with each other.

21. The invention according to claim 18 in which said length adjustment means includes an extension post and an adapter element, said adapter element having a shaft insertion end, a post insertion end and a spacer element therebetween, said shaft insertion end being operatively positioned within said hollow shaft member adjacent said top end of same, and, a portion of said extension post being operatively positionable over and about said post insertion end of said adapter element so as to result in releasable substantially concentric alignment between said hollow shaft member and said extension post.

* * * * *